US008092290B2

(12) United States Patent
Darby

(10) Patent No.: US 8,092,290 B2
(45) Date of Patent: Jan. 10, 2012

(54) CARD GAMING MACHINE WITH LARGE NUMBER OF PAY LINES

(75) Inventor: Roland Lee Darby, Carson City, NV (US)

(73) Assignee: IGT, Reno, NV (US)

( * ) Notice: Subject to any disclaimer, the term of this patent is extended or adjusted under 35 U.S.C. 154(b) by 2628 days.

(21) Appl. No.: 10/339,096

(22) Filed: Jan. 9, 2003

(65) Prior Publication Data

US 2003/0130024 A1 Jul. 10, 2003

Related U.S. Application Data

(63) Continuation of application No. 09/690,538, filed on Oct. 17, 2000, now abandoned.

(51) Int. Cl.
*A63F 9/24* (2006.01)

(52) U.S. Cl. ..... 463/13

(58) Field of Classification Search ..... 463/20, 463/21

See application file for complete search history.

(56) References Cited

U.S. PATENT DOCUMENTS

| | | | | |
|---|---|---|---|---|
| 4,448,419 | A | 5/1984 | Telnaes | 273/143 |
| 4,711,452 | A | 12/1987 | Dickinson et al. | 273/143 |
| 4,837,728 | A | 6/1989 | Barrie et al. | 364/412 |
| 4,948,134 | A | 8/1990 | Suttle et al. | 273/274 |
| 5,630,753 | A | 5/1997 | Fuchs | 463/12 |
| 5,807,172 | A | 9/1998 | Piechowiak | 273/143 R |
| 5,833,536 | A | 11/1998 | Davids et al. | 463/11 |
| 5,851,148 | A | 12/1998 | Brune et al. | 463/25 |
| 5,855,515 | A | 1/1999 | Pease et al. | 463/27 |
| 5,885,158 | A | 3/1999 | Torango et al. | 463/27 |
| 5,947,820 | A | 9/1999 | Morro et al. | 463/9 |
| 5,951,397 | A | 9/1999 | Dickinson | 463/36 |
| 6,027,115 | A | 2/2000 | Griswold et al. | 273/143 |
| 6,220,959 | B1 | 4/2001 | Holmes et al. | 273/292 |
| 6,241,607 | B1 | 6/2001 | Payne et al. | 273/143 R |
| 6,270,405 | B1 | 8/2001 | Ferguson | 273/138.1 |
| 6,270,411 | B1 | 8/2001 | Gura et al. | 273/138.2 |
| 6,290,600 | B1 | 9/2001 | Glasson | 273/143 R |
| 6,322,445 | B1 | 11/2001 | Miller | 273/293 |

OTHER PUBLICATIONS

Fey, Slot Machines, A History of the First 100 Years, Liberty Belle Books, 1983, pp. 76 & 89.*

Marshall Fey, "Slot Machines-A Pictorial History of the First 100 Years," Liberty Belle Books, p. 76 (1983).

* cited by examiner

*Primary Examiner* — Corbett B Coburn
(74) *Attorney, Agent, or Firm* — K&L Gates LLP

(57) ABSTRACT

An electronic card game adapted to be implemented on a non-reel type gaming machine. In one embodiment of the invention, the electronic game can be implemented as a poker game, enabling multiple games to be played simultaneously. The cards for each card game are displayed, for example, in a row or column. When multiple games are played simultaneously, the cards are displayed in a N×M matrix, where N is the number of games played and M is the number of cards per game. For five card poker, the cards are displayed in a N by 5 matrix, where N is the number of games being played simultaneously. In accordance with an important aspect of the invention, the pay lines when multiple simultaneous games are played are not confined to the row or column defining each game. For example, the pay lines may include rows, columns, diagonals, the letters v, c, m and w and other configurations to provide an increased number of pay lines. By providing an increased number of pay lines, larger wagers and thus larger potential pay outs are possible to make the game more attractive to potential players.

1 Claim, 12 Drawing Sheets

A
A
A

One example of a firmware state/flow diagram of the embodied game.

| | | | | |
|---|---|---|---|---|
| | | | | |
| ♥ K | | | ♠ K | ♦ A |
| ♥ A | | ♥ K | | ♥ Q |
| | ♥ K | | | |
| ♠ A ♠ | ♣ K ♣ | ♥ Q ♥ | ♠ J ♠ | ♦ J ♦ |

FIG. 9

| | | | | |
|---|---|---|---|---|
| ♦ A | ♠ K | ♦ K | ♣ K | ♠ K |
| ♥ K | ♦ K | ♠ K | ♠ K | ♦ A |
| ♥ A | ♥ 10 | ♥ K | ♥ J | ♥ Q |
| ♣ A | ♥ K | ♣ K | ♦ K | ♥ K |
| ♠ A ♠ | ♣ K ♣ | ♥ Q ♥ | ♠ J ♠ | ♦ J ♦ |

FIG. 10

| REF | HAND | TOTALS |
|---|---|---|
| A | Royal flush = | 1 |
| B | 5 of a kind = | 0 |
| C | 4 of a kind = | 6 |
| D | Straight flush = | 0 |
| E | Full house = | 1 |
| F | Flush = | 0 |
| G | Straight = | 0 |
| H | 3 of a kind = | 0 |
| I | 2 pair = | 0 |
| J | 1 pair = | 2 |

| | | | | |
|---|---|---|---|---|
| ♥ A | ♠ 8 | ♥ K | ♦ 7 | ♦ 4 |
| ♠ 7 | ♦ 2 | ♦ 7 | ♥ 10 | ♣ 4 |
| ♦ 4 | ♥ J | ♠ 9 | ♦ 4 | ♥ A |
| ♥ Q | ♣ 5 | ♣ 3 | ♥ J | ♠ 4 |
| ♦ 9 ♦ | ♥ Q ♥ | ♠ 4 ♠ | ♥ A ♥ | ♥ 10 ♥ |

FIG. 13

Machine deals cards face up from 1 deck per column

| | | | | |
|---|---|---|---|---|
| ♥ A | | ♥ K | | |
| | | | ♥ 10 | |
| | ♥ J | | | ♥ A |
| ♥ Q | | | ♥ J | |
| | ♥ Q ♥ | | ♥ A ♥ | ♥ 10 ♥ |

FIG. 14

Player selects discards which are removed from matrix

| | | | | |
|---|---|---|---|---|
| ♥ A | ♥ 10 | ♥ K | ♥ Q | ♥ J |
| ♥ J | ♥ K | ♥ A | ♥ 10 | ♥ Q |
| ♥ 10 | ♥ J | ♥ Q | ♥ K | ♥ A |
| ♥ Q | ♥ A | ♥ 10 | ♥ J | ♥ K |
| ♥ K ♥ | ♥ Q ♥ | ♥ J ♥ | ♥ A ♥ | ♥ 10 ♥ |

FIG. 15

Machine deals replacement cards from remaining deck for each column

Machine evaluates the matrix for columns, rows, diagonals and V'S.

| REF | HAND | TOTALS |
|---|---|---|
| A | Royal flush = | 14 |
| B | 5 of a kind = | 0 |
| C | 4 of a kind = | 0 |
| D | Straight flush = | 0 |
| E | Full house = | 0 |
| F | Flush = | 0 |
| G | Straight = | 0 |
| H | 3 of a kind = | 0 |
| I | 2 pair = | 0 |
| J | 1 pair = | 0 |

Paytable for
MEGA POKER

5 Decks used

One deck per column # of columns in payline:

| | 1 | 2 | 3 | 4 | 5 |
|---|---|---|---|---|---|
| Royal Flush | 250 | 125 | 80 | 60 | 50 |
| Straight Flush | 50 | 25 | 15 | 12 | 10 |
| 4 of a kind | 50 | 25 | 15 | 12 | 10 |
| Full house | 9 | 4 | 3 | 2 | 2 |
| Flush | 7 | 3 | 2 | 1 | 1 |
| Straight | 4 | 2 | 1 | 1 | 1 |
| 3 of a kind | 3 | 1 | 1 | - | - |
| 2 pair | 2 | 1 | - | - | - |
| pair of Jacks or better | 1 | - | - | - | - |

Above credit wins are multiplied by the wager on each payline.

| Bonus multiplier (for more than five paylines) | |
|---|---|
| 5 of a kind | Pays 20 x payline wager |
| Order bonus | Pays 5 x payline win |
| Same suit bonus | Pays 2 x payline win |

Same suit bonus applies only to 5 of a kind and full house.

Order bonus applies to straights, straight flushes, and royals when they occur by card value sequence in the payline.

Royal Flushes
with max credits wagered
on winning paylines:

| # of Royals | Wins |
|---|---|
| 14+ | Progressive |
| 14 | 1,000,000 |
| 13 | 52000 |
| 12 | 48000 |
| 11 | 44000 |
| 10 | 40000 |
| 9 | 36000 |
| 8 | 32000 |
| 7 | 28000 |
| 6 | 24000 |
| 5 | 20000 |
| 4 | 16000 |
| 3 | 12000 |
| 2 | 8000 |
| 1 | 4000 |

Only highest wins are awarded for each payline. Malfunctions void all pays and plays.

Example of a typical Mega Card game paytable screen.

FIG. 18

CARD GAMING MACHINE WITH LARGE NUMBER OF PAY LINES

This is a continuation of U.S. Ser. No. 09/690,538, filed Oct. 17, 2000 now abandoned, which is incorporated herein by reference in its entirety.

BACKGROUND OF THE INVENTION

1. Field of the Invention

The present invention relates to an electronic card game and more particularly to an electronic card game that enables multiple simultaneous games to be played in which the pay lines are implemented in a matrix in order to provides increased pay lines and thus increased pay outs to make the game more enticing to players.

2. Description of the Prior Art

Various gaming machines are known. For example, both reel and non-reel type gaming machines are known. Reel type gaming machines normally include three or more rotating reels, either mechanically controlled, as disclosed in commonly owned U.S. Pat. No. 4,711,452, or electronically controlled, as disclosed in commonly owned U.S. Pat. No. 4,448,419. In such reel type gaming machines, various symbols are disposed along the circumference of the reel. Standard reels for standard size gaming machines are known to have 22 stop positions for carrying 22 symbols per reel. In a three reel gaming machine with 22 symbols per reel, the odds of getting three particular symbols are 22×22×22 or 10,648. For a quarter slot machine, $2,662.00 is collected in every 10,648 plays. In order for the game to just break even, the maximum pay out is limited to $2,662.

Slot machines with such low pay outs are not enticing to many potential players. As such, gaming machines with relatively higher pay outs have been developed and found to be more popular with potential players. For example, slot machines with virtual reels are known. Examples of virtual reel slot machines are disclosed in commonly owned U.S. Pat. Nos. 4,448,419 and 5,947,820. In such virtual reel slot machines, the reels are software controlled and are primarily used for display to provide a player with a look and feel of a conventional reel type slot machine. For example, commonly owned U.S. Pat. No. 6,027,115 discloses a virtual reel type slot machine in which the symbols on the reels are provided on electronic displays which enable up to three symbols per stop of a conventional reel for a gaming machine, thus providing 66 symbols per reel.

While virtual reel type gaming machines, as discussed above, provide increased potential pay outs, the technology only applies to reel type gaming machines. As mentioned above, non-reel type gaming machines are also known. An example of a non-reel type gaming machine is an electronic card game, such as disclosed in commonly owned U.S. Pat. No. 5,833,536. Such games are normally played on a gaming machine with a touch screen, for example, as disclosed in commonly owned U.S. Pat. No. 5,951,397. In such electronic card came, the odds and thus the pay outs are relatively limited. Thus, there is a need for an electronic game that can be implemented on a non-reel type gaming machine with an increased pay out relative to known non-reel type gaming machines.

SUMMARY OF THE INVENTION

In one aspect, the invention is directed to a method of playing an electronic card game on a gaming machine is disclosed. The method includes facilitating selection by a player of one or more paylines, dealing a two dimensional array of paying card having five rows of playing cards with each of the rows of playing cards having five playing cards. The method also includes facilitating selection by the player of more than one playing card to be held in the array and replacing the playing cards that were not selected to be held with an equivalent number of replacement cards. The method further includes determining a value payout based on whether one or more of the paylines selected contains a winning combination. The paylines may represent a C-shaped pattern, a U-shaped pattern, a W-shaped pattern, a M-shaped pattern, or a zig-zag shaped pattern.

DESCRIPTION OF THE DRAWINGS

These and other advantages of the present invention will be readily appreciated with reference to the following specification and attached drawings, wherein:

FIG. 9 is an exemplary successive intermediate display, similar to FIG. 8, shown with various cards in each column discarded.

FIG. 10 is an exemplary successive intermediate display, shown with the discarded cards in each column replaced with remaining cards from the same deck.

FIGS. 13-16 are exemplary successive displays illustrating fourteen (14) simultaneous royal flushes.

FIG. 17 is a tabular evaluation of the five (5) hands illustrated in FIG. 16.

FIG. 18 is an exemplary pay table screen.

DETAILED DESCRIPTION OF THE INVENTION

An electronic card game is provided which enables increased wagering and thus increased pay outs. The electronic card game may be implemented on a conventional touch screen gaming machine, for example, as disclosed in commonly owned U.S. Pat. Nos. 5,833,536 and 5,951,397, hereby incorporated by reference. The electronic card game may be implemented as a stand alone game or a part of a progressive system as disclosed in commonly owned U.S. Pat. Nos. 4,837,728; 5,776,076; 5,855,515 and 5,885,158.

The electronic card game may be implemented as an N×M matrix where N is the number of games and M is the number of cards per game. For an exemplary card game for example, stud or draw poker, five cards are displayed in a 1×5 row or column for each hand. Multiple games may be played simultaneously forming an N×M matrix. For example, if five games are played simultaneously, the cards are displayed in a 5×5 matrix, as generally shown in FIGS. 1-10. In accordance with an important aspect of the invention, multiple games may be played at one time to provide increased payouts. For example with a 5×5 matrix of cards as illustrated in FIGS. 1-10, over 100 paylines are possible, thus increasing the odds and the possible pay out of the game to make it more attractive to a player. As used herein, a payline is defined as a pattern any group of cards that start at one side of the matrix and proceeds from card to card, either one row, one column or both (one row and one column per card) to the opposite side of the matrix.

As illustrated in FIGS. 6-10, one card either at the top or bottom of a column may be provided with a different aspect ratio than the balance of the cards in the same column to signify that each column represents a single hand dealt from a single deck. For example, as shown in FIGS. 6-10, all of the cards in each of the columns except the bottom cards are shown with an aspect ratio of about 1. The bottom cards in each of the columns are shown with an aspect ratio less than one and may optionally contain an additional symbol relative to the balance of the cards in the column. By so configuring the aspect ratios of the cards in the columns, the concept of one hand from one deck will be clearly conveyed to the players.

Figure 1:
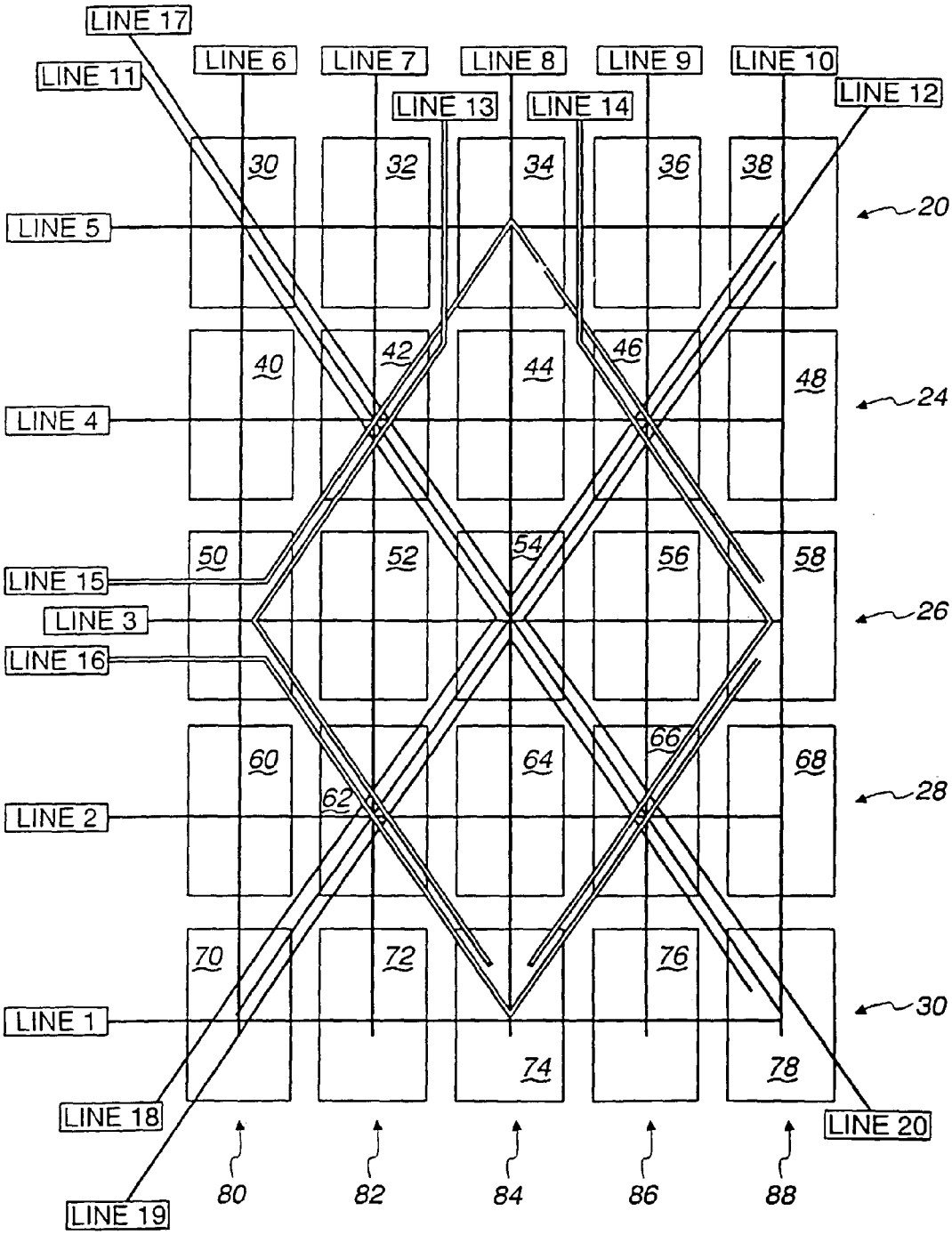
FIG. 1 is a display screen for an exemplary electronic card game illustrating 5 cards per game and 5 games in accordance with the present invention illustrating the exemplary pay lines 1-20.
Figure 2:
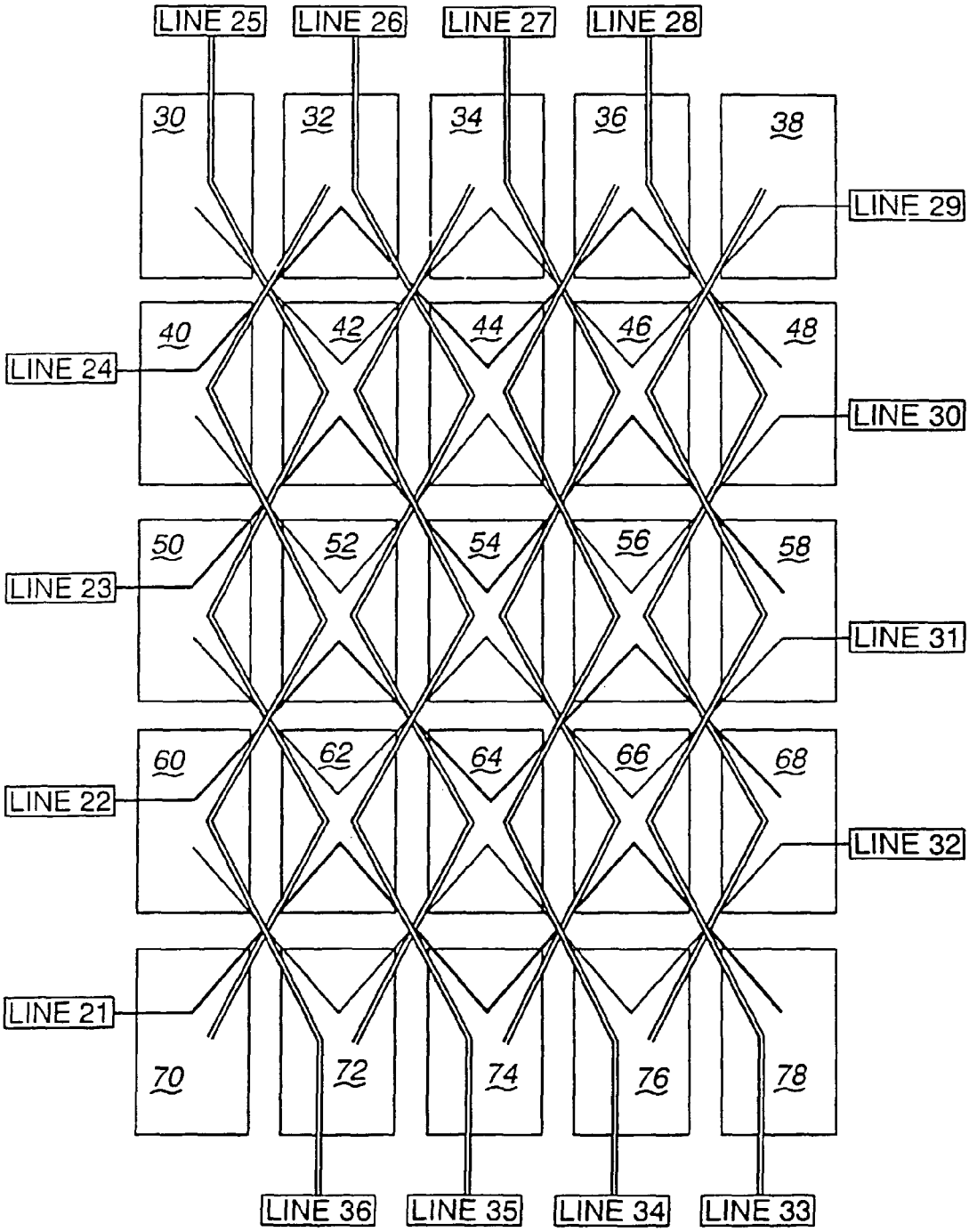
FIG. 2 is similar to FIG. 1 but illustrating exemplary pay lines 21-36.
Figure 3:
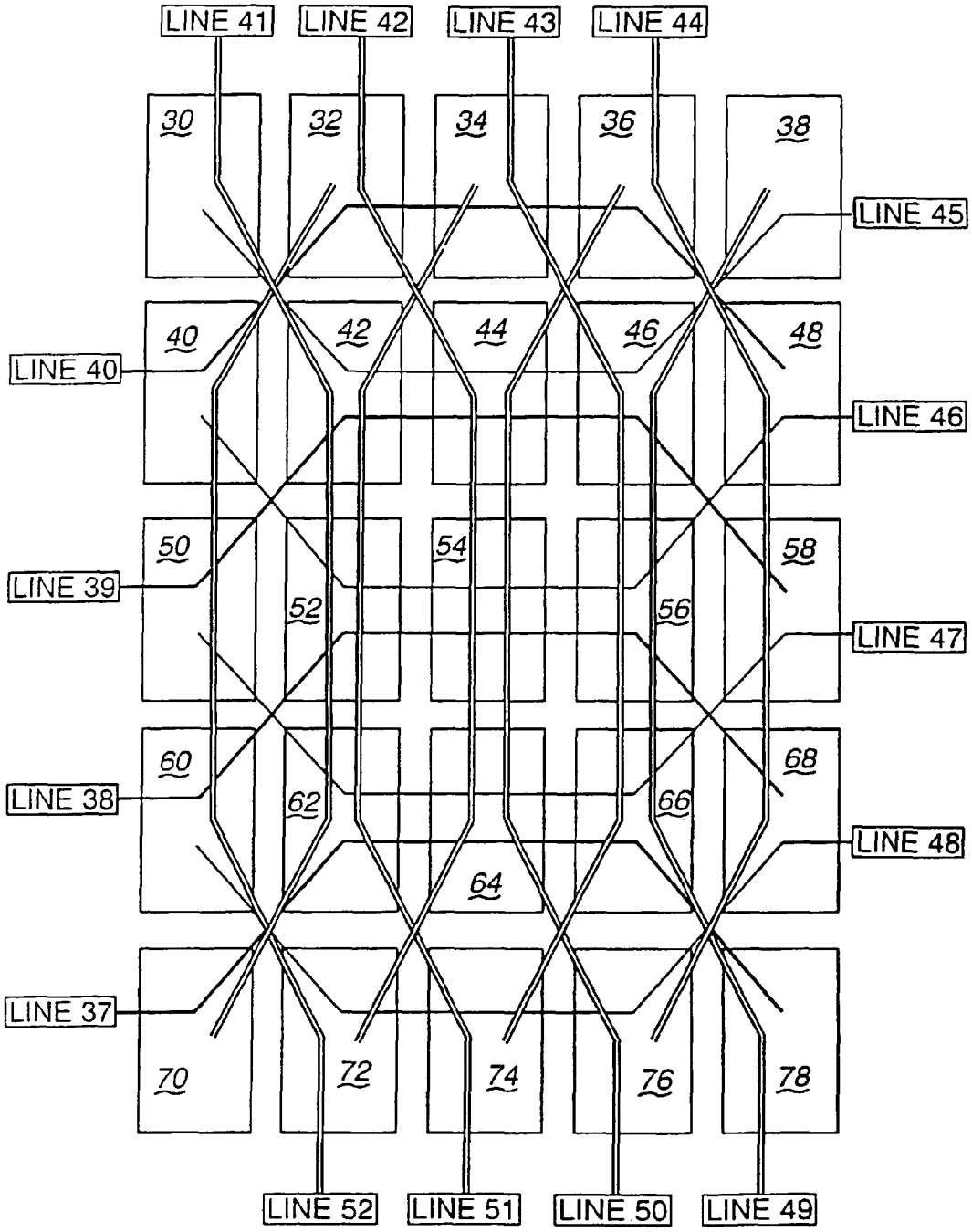
FIG. 3 is similar to FIG. 1 but illustrating exemplary pay lines 37-52.
Figure 4:
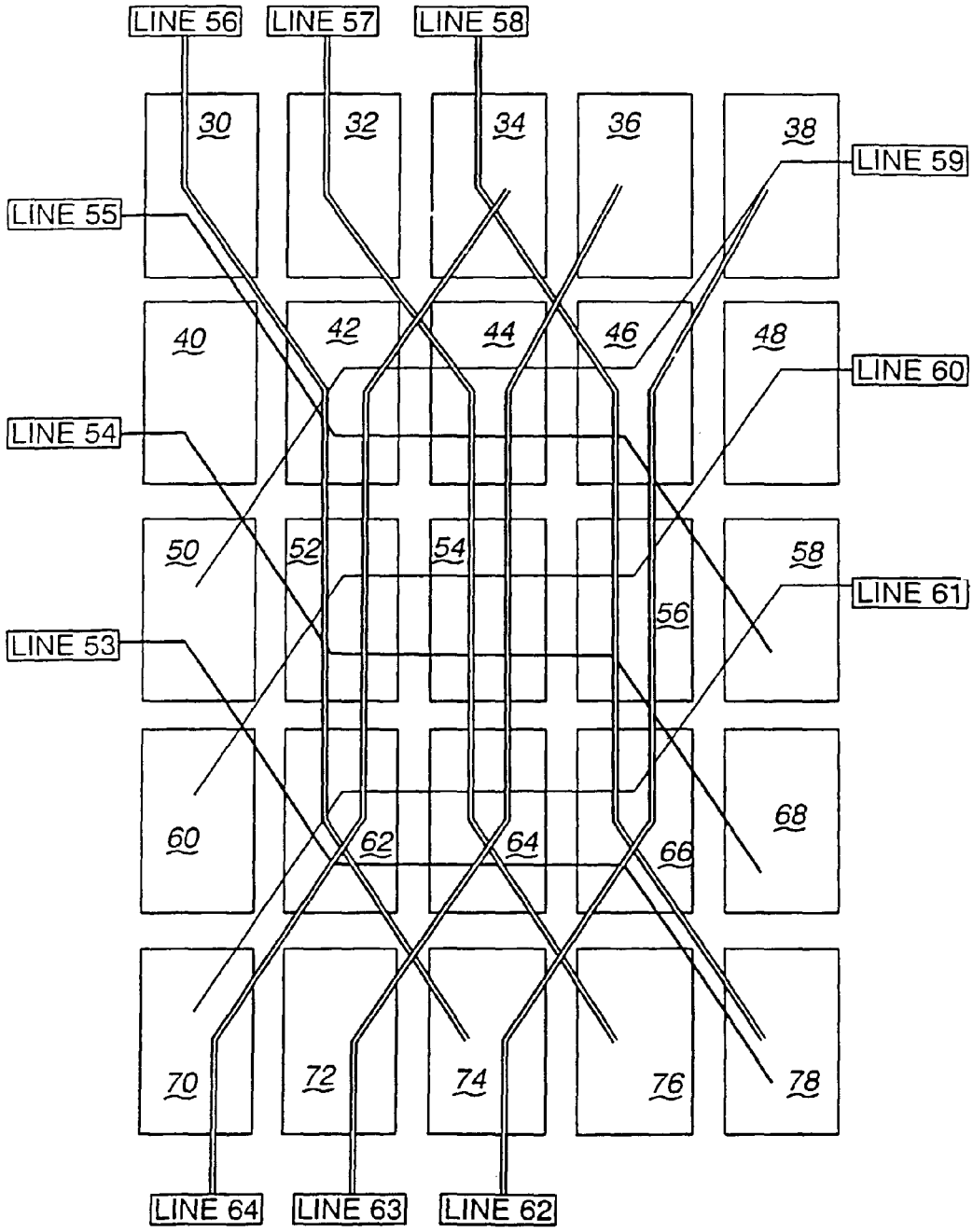
FIG. 4 is similar to FIG. 1 but illustrating exemplary pay lines 53-64.

As illustrated in FIG. 1, each game consists of five cards in a column, generally identified with the reference numerals 80, 82, 84, 86 and 88. In particular, game 1 consists of the cards 30, 40, 50, 60 and 70 in column 80. Similarly, game 2 consists of the cards 32, 42, 52, 62 and 72 in column 82, and game 3 consists of the cards 34, 44, 54, 64 and 74 in column 84. Game 4 consists of the cards 36, 46, 56, 66 and 76 in column 86, while game 5 consists of the cards 38, 48, 58, 68 and 78 in column 88. As a result of games 1-5, five rows are formed. The five rows may be identified, top to bottom, as rows 20, 24, 26, 28 and 30.

In order to provide increased odds and thus increased payouts, paylines are determined in different configuration that include cards from more than one game. In accordance with an important aspect of the invention, the paylines may involve more than one game. For example, each of the paylines 1-5 correspond to rows 20, 24, 26, 28 and 30, respectively, and are therefore associated with five games. Conversely, each of the pay lines 6-10 correspond to columns 80, 82, 84, 86 and 88, respectively, and are therefore associated with one game.

Additional paylines that include cards from more than one game are provided in FIG. 1. For example, a payline 11 shown as a diagonal payline, includes cards 30, 42, 54, 66 and 78. Similarly, a payline 12 shown as a diagonal payline includes cards 38, 46, 54, 62 and 70.

FIGS. 1-4 and Tables 1-4 below illustrate some of the various exemplary configurations of pay lines. For example, the pay lines 13-20 (FIG. 1) illustrate pay lines configured in a letter "v" in various orientations. Pay lines 21-64 (FIGS. 2-4) illustrate other configurations for pay lines, such as the letters C, M, U and W; a zig-zag, and a 1-3-1 combination. Other pay line configurations are also possible, which may include different numbers and configurations of cards within the matrix.

TABLE 1

| Payline | Cards | | | | |
|---|---|---|---|---|---|
| 13 | 34 | 42 | 50 | 62 | 74 |
| 14 | 34 | 46 | 58 | 66 | 74 |
| 15 | 50 | 42 | 34 | 46 | 58 |
| 16 | 50 | 62 | 74 | 66 | 58 |
| 17 | 30 | 42 | 54 | 46 | 38 |
| 18 | 70 | 62 | 54 | 42 | 30 |
| 19 | 70 | 62 | 54 | 66 | 78 |
| 20 | 78 | 66 | 54 | 46 | 38 |

TABLE 2

| Payline | Cards | | | | | Symbol |
|---|---|---|---|---|---|---|
| 21 | 70 | 62 | 74 | 66 | 78 | M |
| 22 | 60 | 52 | 64 | 56 | 68 | M |
| 23 | 50 | 42 | 54 | 46 | 58 | M |
| 24 | 40 | 32 | 44 | 36 | 48 | M |
| 25 | 30 | 42 | 50 | 62 | 70 | ZIG-ZAG |
| 26 | 32 | 44 | 52 | 64 | 72 | ZIG-ZAG |
| 27 | 34 | 46 | 54 | 66 | 74 | ZIG-ZAG |
| 28 | 36 | 48 | 56 | 68 | 76 | ZIG-ZAG |
| 29 | 38 | 46 | 34 | 42 | 30 | W |
| 30 | 48 | 56 | 44 | 52 | 40 | W |
| 31 | 58 | 66 | 54 | 62 | 50 | W |
| 32 | 68 | 76 | 64 | 72 | 60 | W |
| 33 | 78 | 66 | 58 | 46 | 38 | ZIG-ZAG |
| 34 | 76 | 64 | 56 | 44 | 36 | ZIG-ZAG |
| 35 | 74 | 62 | 54 | 42 | 34 | ZIG-ZAG |
| 36 | 72 | 60 | 52 | 40 | 32 | ZIG-ZAG |

TABLE 3

| Payline | Cards | | | | | Symbol |
|---|---|---|---|---|---|---|
| 37 | 70 | 62 | 64 | 66 | 78 | Inverted U |
| 38 | 60 | 52 | 54 | 56 | 68 | Inverted U |
| 39 | 50 | 42 | 44 | 46 | 58 | Inverted U |
| 40 | 40 | 32 | 34 | 36 | 48 | Inverted U |
| 41 | 30 | 42 | 52 | 62 | 70 | Reverse C |
| 42 | 32 | 44 | 54 | 64 | 72 | Reverse C |
| 43 | 34 | 46 | 56 | 66 | 74 | Reverse C |
| 44 | 36 | 48 | 58 | 68 | 76 | Reverse C |
| 45 | 38 | 46 | 44 | 42 | 60 | U |
| 46 | 48 | 56 | 54 | 52 | 40 | U |
| 47 | 58 | 66 | 64 | 62 | 50 | U |
| 48 | 68 | 76 | 74 | 72 | 60 | U |
| 49 | 78 | 66 | 56 | 46 | 38 | C |
| 50 | 76 | 64 | 54 | 44 | 36 | C |
| 51 | 74 | 62 | 52 | 42 | 34 | C |
| 52 | 72 | 60 | 50 | 40 | 32 | C |

TABLE 4

| Payline | Cards | | | | | Symbol |
|---|---|---|---|---|---|---|
| 53 | 50 | 62 | 64 | 66 | 78 | 1-3-1 |
| 54 | 40 | 52 | 54 | 56 | 68 | 1-3-1 |
| 55 | 30 | 42 | 44 | 46 | 58 | 1-3-1 |
| 56 | 30 | 42 | 52 | 62 | 74 | 1-3-1 |
| 57 | 32 | 44 | 54 | 64 | 76 | 1-3-1 |
| 58 | 34 | 46 | 56 | 66 | 78 | 1-3-1 |
| 59 | 38 | 46 | 44 | 42 | 30 | U |
| 60 | 48 | 56 | 54 | 52 | 40 | U |
| 61 | 58 | 66 | 64 | 62 | 50 | U |
| 62 | 74 | 66 | 56 | 46 | 38 | 1-3-1 |
| 63 | 72 | 64 | 54 | 44 | 36 | 1-3-1 |
| 64 | 70 | 62 | 52 | 42 | 34 | 1-3-1 |

GENERAL DESCRIPTION OF THE GAME

The electronic card game in accordance with the present invention relates to a card game in which the player plays N columns of M rows of cards, for example as shown in FIGS. 1-4 and 7-11. A wager is placed on each payline that the player wishes to play. Players then get the opportunity to select from zero to five cards per hand to be discarded. The discarded cards are removed from the matrix and new cards are dealt from the remaining cards in the decks for each column. The matrix is then evaluated for all payline combinations which have wagers placed by the player. The player receives credits for each winning payline. The credits won are based upon a pay table, for example, as illustrated in FIG. 12, which may be multiplied by the initial wager placed on each payline.

Figure 5:
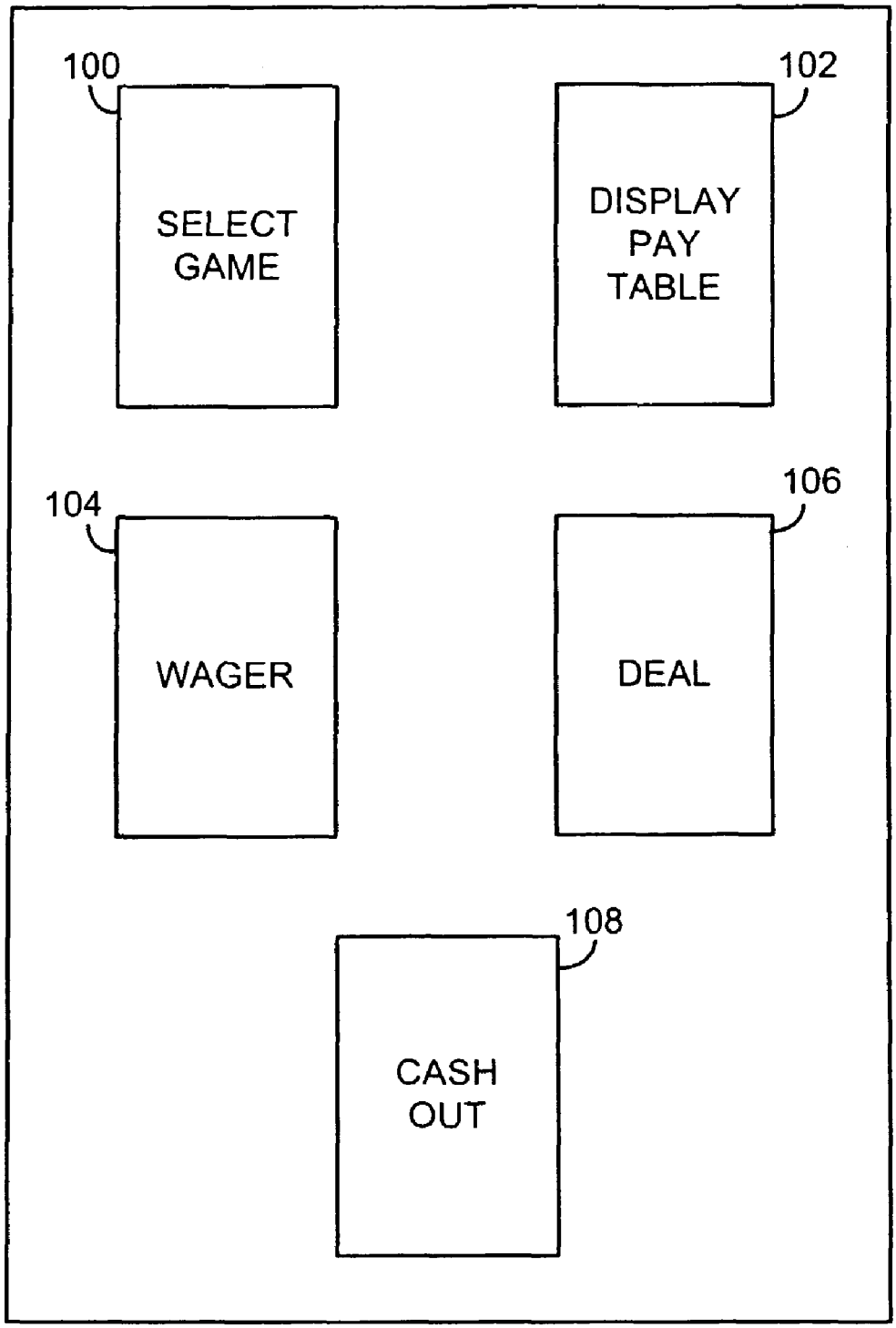
FIG. 5 is a diagram illustrating various player inputs for the electronic card game in accordance with the present invention.

FIG. 5 illustrates an exemplary display of player inputs. The player input devices may consist of a touch screen and or player input switches or other means. The various player inputs may include one or more of the player inputs illustrated in FIG. 5 which include the inputs identified with the reference numerals 100, 102, 104, 106 and 108.

Figure 6:
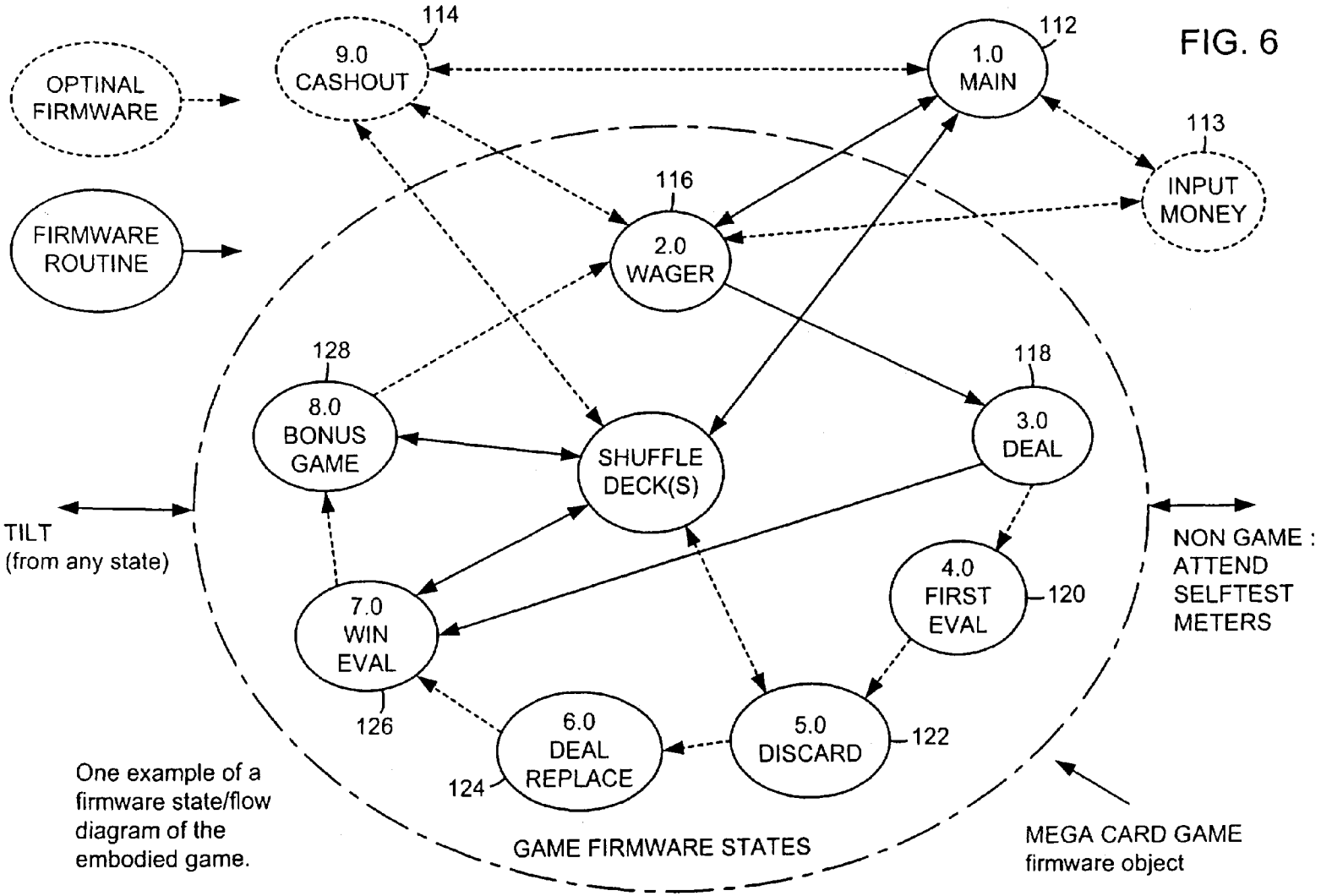
FIG. 6 is a state/flow diagram of the software for the electronic card game in accordance with the present invention.
Figure 7:
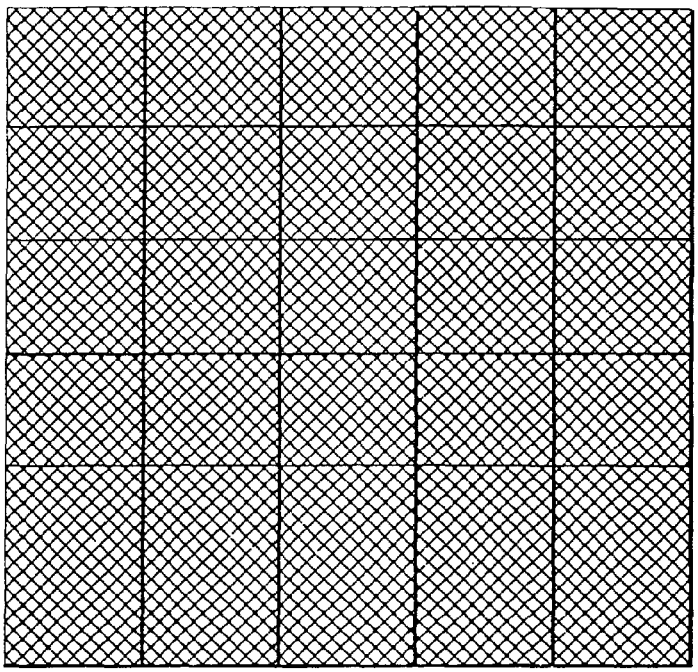
FIG. 7 is an initial display of the electronic card game in accordance with the present invention, shown with all of the cards face down, in an exemplary 5×5 matrix with one deck per column.

Turning to FIG. 6, an electronic gaming machine is normally in an initial state identified with the reference numeral 112. In this state, a player may optionally initiate credits in a gaming machine by inserting coins, currency or cashless vouchers as indicated in step 113. Once the credits are validated by the gaming machine in a conventional manner, a player may select a game from an initial game menu display by way of the player input device 100. In accordance with an important aspect of the invention, the electronic card game may enable the player to select one or more choices from a menu of various different games. The software for each of the games is similar to FIG. 6. Once the game is selected, the cards in each deck are shuffled and the machine displays the total available credits and initializes the game. In state 116, once the games are selected, the machine displays the card matrix with all cards shown face down, as illustrated in FIG. 7. The pay table and payline for each game may be displayed by depressing a "Display Paytable" 102 player input device (FIG. 5). Once the pay table is selected, a player can wager different amounts on each matrix payline up to the maximum bet or until the remaining credits are equal to zero by selecting a "Wager" 104 player input device. The gaming machine decrements a credit display as a wager and waits for a deal input from the player.

Figure 8:
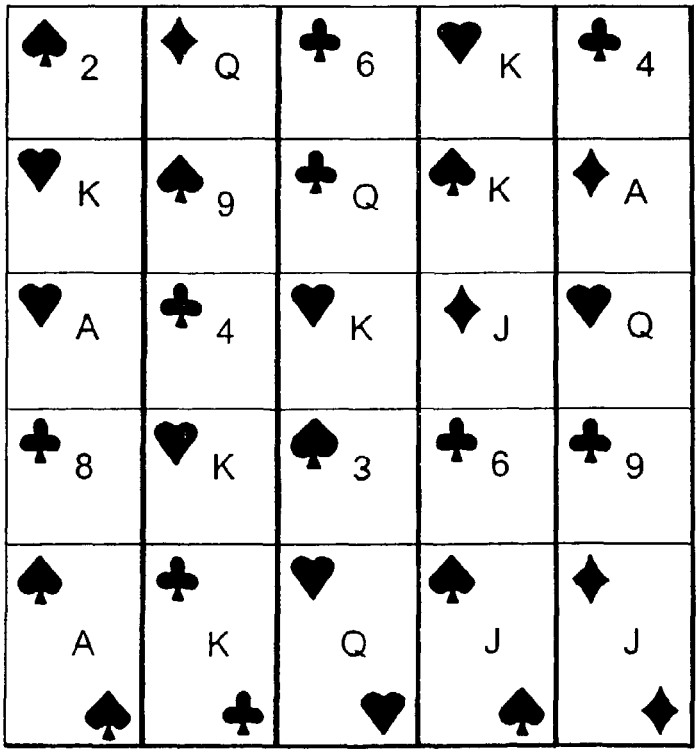
FIG. 8 is an exemplary intermediate display of the electronic card game in accordance with the present invention, shown with all of the cards face up.

In step 118 (FIG. 6), a player selects a "Deal", player input device 106 (FIG. 5). When the Deal input device 106 is activated, the system deals M columns of N cards for the games selected in step 112 (FIG. 6). Each hand is dealt from a standard deck which may contain one or more extra jokers, and/or other cards depending on the game selected by the player, as illustrated in FIG. 8. After the cards are dealt in step 118 (FIG. 6), the system may optionally include an evaluation state 120. In this state, the system may evaluate the matrix and display possible wins for each payline played. The system may also display a suggested hold strategy to assist the player in state 122.

In state 122, the player is optionally allowed to select anywhere from zero to all of the cards to be discarded and removed from display. This option may be executed by way of a touch screen display, discussed above, in which the player is allowed to select either cards to be played or cards to be discarded. The discarded cards are removed from the display as illustrated in FIG. 9 while the machine reshuffles the deck for each hand for each column. The system then proceeds to step 124 and awaits for the player to select a "Deal Cards" input device 106 (FIG. 5). Once the input device 106 is selected, replacement cards for each column from the remaining cards in each deck are dealt and displayed in the appropriate columns, as illustrated in FIG. 10. States 122 and 124 are optional states depending on the particular games selected or game being played.

Figures 16, 17:
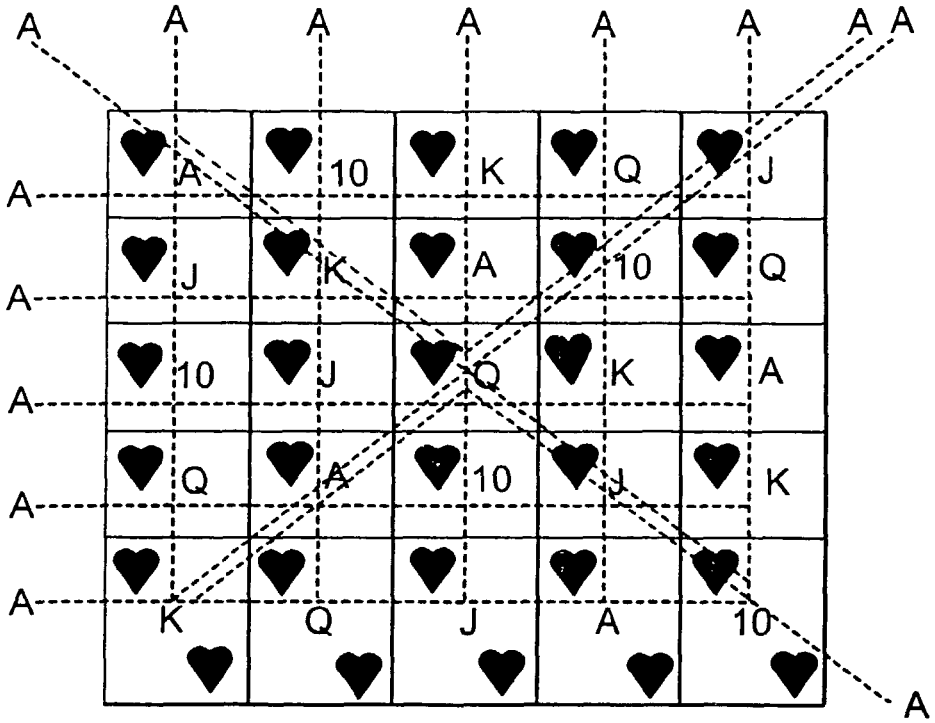

An exemplary display sequence for fourteen (14) simultaneous royal flushes is illustrated in FIGS. 13-16. An exemplary evaluation of the five (5) hands illustrated in FIG. 16 is illustrated in FIG. 17.

Figures 11, 12:
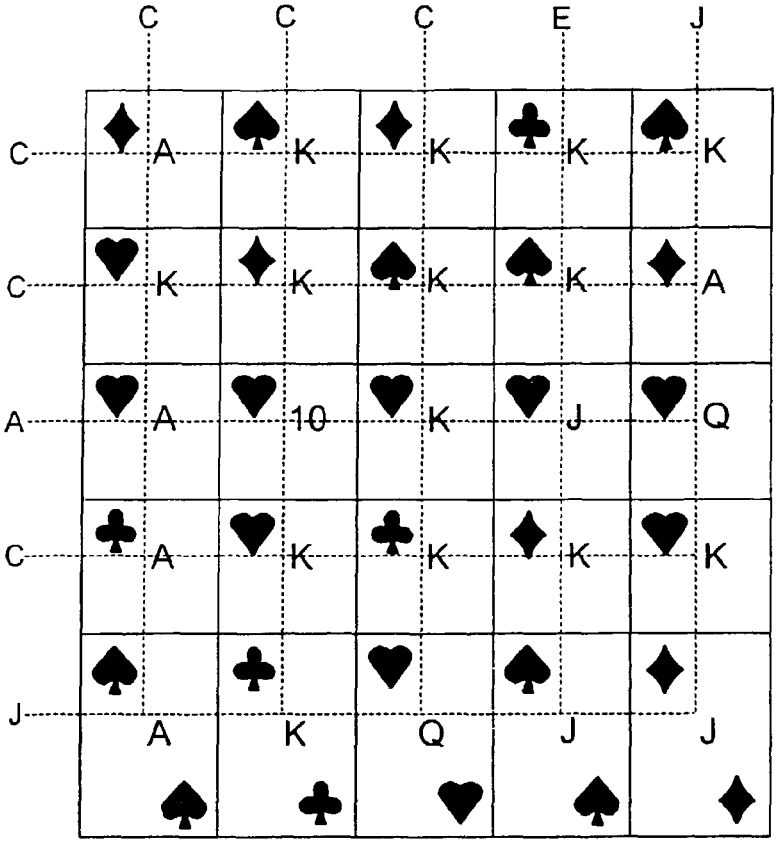
FIG. 11 is an exemplary display illustrating the payline evaluation of the five hands illustrated in FIG. 10.
FIG. 12 is a tabular evaluation of the five hands illustrated in FIG. 10.

The system then proceeds to state 126 and evaluates the entire matrix for each combination of cards for each payline for pay amounts and the outcome of the play for all pay lines, for example as illustrated in FIG. 11. Exemplary pay lines are illustrated in FIG. 11, as dotted lines and identified with the characters A-J. An exemplary pay table screen is illustrated in FIG. 18. For the exemplary hands illustrated in FIG. 11, an exemplary paytable is illustrated in FIG. 12. The credits, for example, are illustrated in the pay table under the column labeled "Totals" and multiplied by the amount of wager per payline. The matrix evaluation of payout for each payline is dependent upon the standard underlying card game, such as draw poker, stud poker, etc. The ranking and payouts for possible card combinations are related to the specific card game and the mathematical probability of being dealt specific card combination on a specific payline as is well known in the art.

After the player credits are established in step 126, the system may allow for optional post game bonus play, such as double or nothing as indicated in step 128 or may proceed to cash out in step 114. If post game bonus play is initiated, the system reshuffles the deck and proceeds through steps 112-126.

After the credits are established in step 126, a player may proceed to an optional cash out option 114 by selecting the "Cash Out" player input device 108, (FIG. 5), in which case, the machine can optionally payout in coins and vouchers or combination of the two. Alternatively, the player can return to step 112, if credits are greater than 0. In this step, the system proceeds as discussed above and shuffles the decks or upon player activation cashes out, ends the game and returns to step 112.

Obviously, many modification and variations of the present invention are possible in light of the above teachings. For example, while the flow charts use draw poker as an example, other forms of poker and other card games and non-card games are well known to those skilled in the art and fall within the spirit and scope of the invention. Thus, it is to be understood that, within the scope of the appended claims, the invention may be practiced otherwise than as specifically described above.

What is claimed and desired to be secured by Letters Patent of the United States is:

1. A method of playing an electronic card game on a gaming machine, said electronic card game having a plurality of paylines, said method comprising:

initiating said electronic card game after deposit of value into said gaming machine;

facilitating selection by a player of one or more paylines from among a plurality of paylines;

dealing a two dimensional array of playing cards from one or more decks of cards, said two dimensional array of playing cards having five rows of playing cards, each of said five rows of playing cards having five playing cards;

facilitating selection by the player of one or more playing cards to be held in each of said rows, comprising selection by the player of a first number of playing cards in a first of said rows and a second number of playing cards in a second of said rows, said first number of cards being different than said second number of cards;

replacing said playing cards that were not selected to be held with an equivalent number of replacement playing cards selected from a remainder of said playing cards in said one or more decks of cards; and determining a value payout based on whether one or more of said paylines selected by said player from said plurality of paylines contains a winning combination, wherein said each of said plurality of paylines represents a pattern of five playing cards within said two dimensional array of playing cards.

* * * * *

UNITED STATES PATENT AND TRADEMARK OFFICE

CERTIFICATE OF CORRECTION

PATENT NO. : 8,092,290 B2
APPLICATION NO. : 10/339096
DATED : January 10, 2012
INVENTOR(S) : Roland Lee Darby It is certified that error appears in the above-identified patent and that said Letters Patent is hereby corrected as shown below:

IN THE CLAIMS:

In Claim 1, column 6, line 65, before “cards” add --playing--.

In Claim 1, column 7, line 5, before “cards” add --playing--.

In Claim 1, column 7, line 6, before “cards” add --playing--.

In Claim 1, column 7, line 10, before “cards” add --playing--.

In Claim 1, column 8, line 4, after “wherein” delete “said”.

Signed and Sealed this
Twentieth Day of March, 2012

David J. Kappos

David J. Kappos
*Director of the United States Patent and Trademark Office*